United States Patent [19]

Belge

[11] 3,939,767

[45] Feb. 24, 1976

[54] APPARATUS FOR IMPRINTING SELECTED CHARACTERS ON A MOVABLE RECORD MEDIUM

[75] Inventor: Dieter Belge, Schwenningen, Germany

[73] Assignee: Carl Valentin GmbH, Schloss Burgberg, Germany

[22] Filed: Feb. 28, 1974

[21] Appl. No.: 446,770

[30] Foreign Application Priority Data

Apr. 25, 1973 Germany ..... 2320792

[52] U.S. Cl. ..... 101/99; 101/45; 101/93.41; 101/110

[51] Int. Cl.[2] ..... B41J 11/18

[58] Field of Search..... 101/93.14, 93.21, 93.22, 101/93.37, 93.38–93.42, 110, 95, 99, 45; 235/60 P, 58 P

[56] References Cited

UNITED STATES PATENTS

| | | | |
|---|---|---|---|
| 2,034,112 | 3/1936 | Mixer | 101/93.21 |
| 3,422,754 | 1/1969 | Bakardjiev et al. | 101/99 X |
| 3,621,777 | 11/1971 | Clary | 101/93.41 |
| 3,756,147 | 9/1973 | Gross et al. | 101/93 |
| 3,824,922 | 7/1974 | Van Acker | 101/45 |

*Primary Examiner*—Edgar S. Burr
*Assistant Examiner*—Edward M. Coven
*Attorney, Agent, or Firm*—Lawrence E. Laubscher

[57] ABSTRACT

A printing device for imprinting selected characters from a plurality of type wheels on a record medium is described. Control means are provided for selectively adjusting each of the type wheels to bring selected characters of each of said type wheels into registry with printing positions on the record medium. The control means includes adjusting means for each of said type wheels which are conjointly driven by a common drive means. Means are provided for inhibiting the operation of selected adjusting means when the associated type wheels have reached the selected printing position. Elastic coupling means are provided between the drive means and each adjusting means to permit the continued movement of said drive means independently of an inhibited condition of one or more of said adjusting means. Means are further provided for storing information to program the operation of the control means.

5 Claims, 1 Drawing Figure

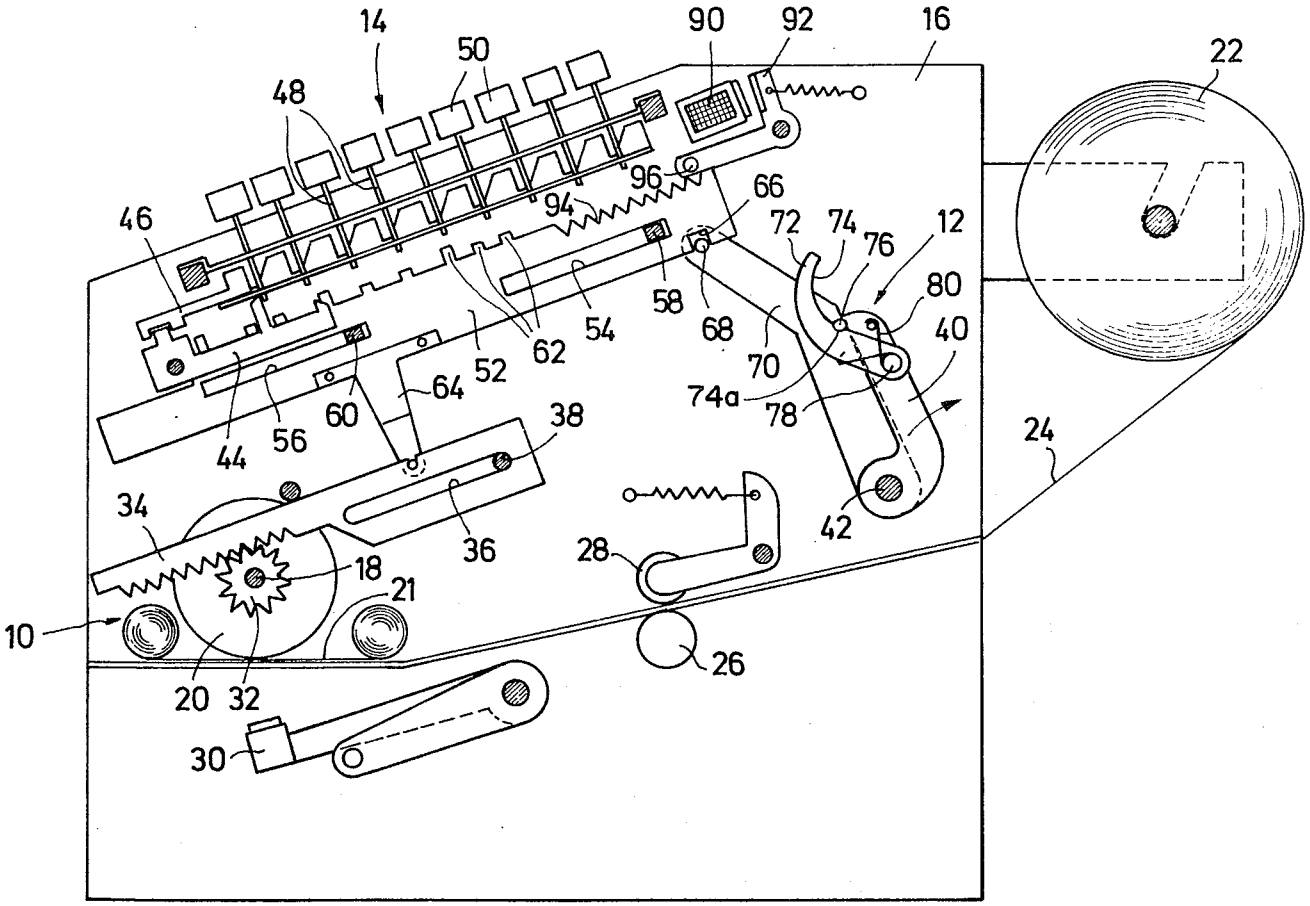
22
24
16
12
80
40
76
74
72
42
78
70
74a
66
68
92
90
96
58
54
94
62
52
38
36
50
64
14
60
21
18
48
56
44
32
20
30
46
34
10
28
26

APPARATUS FOR IMPRINTING SELECTED CHARACTERS ON A MOVABLE RECORD MEDIUM

The present invention relates to a printing apparatus for imprinting selected characters on a movable record medium. More specifically the present invention relates to a printing mechanism having a set of juxtaposed type wheels with a plurality of characters thereon and control means for selectively adjusting said type wheels to bring selected characters thereon into registry with printing positions on the record medium.

Imprinting devices of this general type are already known in the art. However, in these prior art constructions, the setting or adjustment of the type wheels is effected directly by means of a setting device once the information to be printed has been fed thereinto. Such a setting of the type wheels generally can be accomplished with an expensive control mechanism.

It is the object of the present invention to structurally simplify imprinting devices of this type and category and to provide them in such a manner that the setting of all of the type wheels takes place simultaneously and independently of the input or feed of the information into the setting device.

This object of the present invention is fulfilled by virtue of the fact that the information which determines the selective adjustment of the type wheels to be fed into the control device is adapted to be stored therein; that the setting members of the control device are displaceable by means of a drive member which, during each setting operation, passes through a predetermined maximum adjusting path; and that the setting movement of these setting members by the setting device corresponding to the stored information can be interrupted, independently of the movement of the drive member, when the type wheels assume a position in which the symbol or character value that corresponds to the information fed into the control device is in the printing position.

In a preferred embodiment the setting means include toothed racks which mesh with a toothed pinion coupled to the type wheels. The length of the adjusting path of the toothed racks is adjustable by means of stop means which are selectively actuated by the control device. The drive member traverses a predetermined maximum path corresponding to the maximal angle of rotation of the type wheels for any selected combination of adjustment of the type wheels and is elastically coupled with a setting member serving for the drive of the toothed racks.

In a preferred embodiment the drive member and the setting members comprise first and second pivotable levers, respectively. The first pivotable lever is rigidly affixed to a pivot shaft while the second pivotable lever is freely rotatably positioned thereon. An elastic driving connection is provided between these two pivotable levers. In a preferred embodiment, one of the pivotable levers has a pivotable engaging lever secured thereto which is rotatable on an axis parallel to the axis of the pivotable shaft and which, with a concavely curved edge, engages behind a lateral shoulder or extension of the other pivotable lever. Coupled to this engaging lever is a spring which seeks, by means of the engaging lever, to hold the pivotable lever serving as setting member against the pivotable lever serving as a drive member.

The control device for storing information relating to the characters to be selected on the type wheels may comprise a bank of keys equipped with a zero lever slide. The keys are provided with spars which serve as stop means which selectively engage and limit the travel of the toothed racks. In this case, each toothed rack is advantageously secured to a connecting rod each of which is operatively associated with one row of keys and in operative engagement with the key spars constituting the stops. The connecting rod is coupled to and displaceable by means of the pivotable lever forming the setting member in the plane of the associated row of keys.

The present invention will now be further described hereinafter with reference to the accompanying drawing the single figure of which is a longitudinal cross-sectional view through one embodiment of the printing device of the present invention.

With the aid of the printing device as disclosed and described herein it is possible to print on a movable record medium, particularly labels, selected characters. It is particularly suitable for providing price or content data on labels for making merchandise.

The printing device of the present invention comprises a printing mechanism generally identified 10, a drive mechanism generally identified 12, and a setting device generally identified 14 for setting the symbol or character values that are to be printed on a data carrier by means of the printing mechanism 10. These mechanisms 10, 12, 14 are supported and disposed between a pair of parallel support plates 16.

The printing mechanism 10 includes a plurality of type wheels 20 which are rotatably disposed with a small spacing on a common bearing axle 18 journaled in side support plates 16. The type wheels have a plurality of characters disposed around the circumference thereof at a uniform angular spacings. These characters may comprise numbers or any alpha-numeric symbols.

Let it be assumed that, in a preferred embodiment, it is intended to print with the aid of the printing mechanism 10 price data on individual labels for the purpose of marking merchandise. For this purpose, there is guided below the type wheels 20 an ink ribbon 21 with which a web of paper 24 carrying individual labels can be drawn off of a spool 22. The web of paper 24 is gradually pulled into the device by means of a draw-off roller 26 to which a counter roller 28 is coupled. The paper is moved past the type wheels 20, whereby an unprinted label is brought into registry with type wheels 20. Reference numeral 30 identifies a printing hammer which is operatively associated with type wheels 20 and which executes a striking movement in a manner for pressing the label against ink ribbon 21 and the selected characters on type wheels 20.

For purposes of adjusting the type wheels, a set wheel 32, provided as a gear wheel, is coupled to each type wheel 20. These set wheels 32 are positioned on one end face of the type wheels 20 and are in form-locking engagement with a toothed rack 34 bringing about the adjusting movement. The toothed racks 34 coupled to the type wheels 20 are movable in rectilinear paths. Elongated slots 36 are provided in toothed racks 34 for receiving guide rods 38 which are rigidly affixed between side plates 16.

For displacing the toothed racks for adjusting the type wheels 20 a driving or actuating lever 40 is provided which is disposed on a pivot shaft 42 so as to be rigid against rotation. Pivot shaft 42 is rotated by means of a suitable drive means. For each adjusting operation, i.e. for each new setting or adjustment of the type wheels 20, pivot shaft 42 is rotated in the direction indicated by arrows about a given angle such that the toothed racks 34 are conjointly displaced by the drive lever 40. The length of the adjusting path of the toothed racks 34 is determined by the setting device 14 corresponding to the information that is stored therein, independently of the pivoting movement of the drive lever 40. The setting device 14 preferably includes a bank of keys which is equipped with a zero return lever slide 46 controlling a zero return lever 44, and in each case one row of keys corresponding for example to a number of digits of a figure to be printed is associated with each type wheel 20. A connecting rod 52 is provided which is displaceably guided by means of elongated slots 54, 56 on stationary guide rods 58, 60 secured in side plates 16. Connecting rod 52 comprises on the long side thereof facing the row of keys one stop projection 62 per key spar 48 of individual keys 50. As shown in the drawing, the stop projections 62 and/or the key spars 48 have configurations such that each key spar corresponds with a different projection, respectively, whereupon actuation of a given key results in connecting rod 52 shifting to the right to a position in which the corresponding stop projection 62 engages the spar of the actuated key, the type wheel 20 having been rotated through an angle causing the appropriate character thereon to be adjacent the printing medium 24. Secured to each connecting rod 52 by means of a connecting arm 64 is one of the toothed racks 34. A bolt 68 of a setting lever 70 which is pivotally disposed on the pivot shaft 42 engages in recess 66 in connecting rod 52. This setting lever 70 is resiliently coupled with the driving lever 40 in such a manner that the driving lever 40 is then adapted to drive the individual setting levers 70. Accordingly, setting levers 70 can displace by means of connecting rods 52 the toothed racks 34 about a niaximal adjusting path when no key is depressed. In order to insure that the displacing movement of the connecting rods can be interrupted independently of the pivoting movement of the driving lever 40 when the type wheels assume a position in which the number that corresponds to the information being locked in the setting device is in printing position, an engaging lever 72 positioned on an axis parallel with respect to the pivot shaft 42 is hingedly connected for example with the driving lever 40. Engaging lever 72 hooks or engages with concavely curved edge 74 thereof behind a lateral stop pin 76 extending from setting lever 70. Disposed on the pivot axle 78 of the engaging lever 72 is a torsion spring 80 which seeks by means of the engaging lever 72 to pivot the setting lever 70 into a position parallel to and against the driving lever 40. The curved surface 74 contains a recess 74a that receives the stop pin 76 when the levers 40 and 70 are in their illustrated normal adjacent positions.

The key return spring means (not shown) and the zero slide and zero lever means for returning the keys to their illustrated retracted positions when the connecting rod 52 is returned to the illustrated position form no part of the instant invention, and consequently will not be further described.

The printing device described hereinabove operates as follows:

After each printing operation, the driving lever 40 corresponding to each row of keys, the setting lever 70 with connecting rod 52, toothed rack 34 and the type wheel 20 are returned into the starting position indicated in the drawing. In that position, all of the type wheels are in the same position, i.e. that same character, in the present case the number 0, is in printing position. In order to make labels on which a specific price information or indication is imprinted, it is necessary to initially feed a corresponding information to the setting device 14, by tapping a specific numerical value in the bank of keys. By virtue of this tapping of keys, the setting movement required for the setting of the type wheels 20, of the toothed racks 34 and of the connecting rods 52 is established in the setting device 14, in that the spars 48 of the depressed keys 50 serves as stop means for the connecting rod 52 corresponding to the respective rows of keys. When the numerical value corresponding to the price to be printed has been tapped in, the setting operation or procedure for setting the type wheels 20 is initiated by means of a starter key not further illustrated herein. The driving lever 40 is pivoted by the pivot shaft 42 in the direction shown by arrows about a predetermined angle. By way of the engaging lever 72, the setting levers 70 being connected in each case with a connecting rod 52 are conjointly pivoted at that time so that the connecting rods 52 and the toothed racks 34 will be set in motion in the longitudinal direction. This setting movement of elements 34, 52, 70 takes place or continues until the stop projection 62 of the individual connecting rods which corresponds to the spar of the depressed key strikes against the spar 48. Due to this driving of the connecting rods 52 along the corresponding key spars 48, there occurs an interruption in the drive of the rods 34, 52, and at that time, the type wheels that have been brought to a standstill thereby will assume a printing position wherein the number which is tapped into the row of keys is in registry with the label strip 24. During one setting operation, the respective connecting rods 52 and the associated toothed racks 34 will thus execute different setting movements corresponding to the respective numbers tapped into the various rows of keys. However, the driving lever 40 is pivoted about a predetermined angle which is at least as great as the angle of rotation necessary for the number having the highest value on the type wheels to arrive in a printing position. This means that in the course of one setting operation, as soon as the connecting rods 52 cooperate with the spar 48 of the respectively depressed key of the corresponding row of keys, the setting lever 70 comes to a standstill and the driving lever 40 executes a relative movement with respect thereto. Therefore, the setting movement of the toothed racks 34 is interrupted by the setting device 14 corresponding to the tapped-in information, independently of the movement of the driving lever 40. When the type wheels 20 have been set, the printing hammer 30 becomes operative and presses the label against type wheels 20 for a short period of time, whereupon the draw-off roller 26 puts the paper strip into motion in order to place a new label in printing position. This draw-off roller is preferably driven by way of an electromagnetic coupling, and the circuit may be controlled by a photoelectric cell.

The imprinting device may further be equipped with a preselection counter so that, after the completed setting of the type wheels by the device, a plurality of duplicate labels may be printed until the number of labels having been set or chosen by the preselection counter has been reached. Upon the completion of the printing operation, the rocking shaft 42 returns the driving lever 40 to the starting position thereof, whereupon by way of the setting levers 70 all of the connecting rods 52, toothed racks 34, and all of the type wheels are once again placed in the starting position. At the same time, the depressed keys are unlocked in a manner known per se so that a new setting of the imprinting device is made possible.

In order to allow for controlling the printing device electrically, as an alternative to the mechanical key board, each connecting rod may be operatively associated with an annular toggle lever 92 adapted to be controlled by an electromagnet 90. The connecting rods 52 may be equipped at the long side thereof with notched recesses 94 the number of said recesses corresponding to the number of characters existing on each of the type wheels 20. With a notch bolt 96, the toggle lever 92 may in this case engage or lock in the notches when the magnet 90, in the course of a selected operation, is controlled at a specific period of time by a setting device. This control or operation takes place in such a manner that the rocking lever 92 will engage in the respective notch recess 94 which corresponds to the selected character of the corresponding type wheel that happens to be in printing position at that time. Thus it is thereby possible to control the imprinting device for example through the digital unit of an electric cash register in order to imprint with its aid cash vouchers, vouchers or coupons or check stubs. An imprinting device conceived in this manner may equally be connected to process counters or serve as imprinting or marking devices for labels etc. on electronic scales and the like.

The apparatus of the present invention may be modified as would occur to one of ordinary skill in the art without departing from the spirit and scope of the present invention.

It is claimed:

1. In a printing apparatus for printing characters on a printing medium, including a plurality of rotatable type wheels (20) each having a plurality of characters on the periphery thereof, drive means normally rotating said wheels through operating angles causing all of the characters thereon to be successively arranged in printing positions relative to said printing medium, and keyboard means for interrupting the rotation of the type wheels to positions in which selected characters thereon are in printing positions, respectively, relative to said printing medium; the improvement wherein said drive means comprises a. common drive lever means including a plurality of pivotable drive levers (40) associated with said type wheels, respectively, and means (42) for simultaneously pivoting said drive levers between first and second positions, respectively; and b. means connecting each of said type wheels with its associated drive lever, respectively, comprising 1. a toothed set wheel (32) coupled with the associated type wheel;
2. a longitudinally slidable rack (34) having teeth that engage the teeth of said set wheel;
3. a setting lever (70) pivotable at one end about an axis parallel with the pivot axis of said drive lever;
4. connecting rod means (52) associated with said keyboard means for connecting the other end of said setting lever with said rack; and
5. means (72,80) resiliently connecting said setting lever with said drive lever, said connecting means being normally operable, upon pivotal movement of said drive lever from said first position to said second position, to rotate the associated type wheel through the aforementioned operating angle, whereby when all of the drive levers are pivoted from their first positions toward their second positions, displacement of said connecting rod means may be interrupted by said keyboard means at positions causing desired characters on said type wheels to be in printing positions, respectively, relative to said printing medium.

2. Apparatus as defined in claim 1, wherein said resilient connecting means includes an engaging lever (72) pivotally connected with one of said drive and setting levers, said engaging lever having a concavely curved surface, the other of said drive and setting levers having a lateral extension engageable with said curved surface, and spring means (80) normally biassing said engaging lever to bias said setting and drive levers together.

3. Apparatus as defined in claim 2, wherein said lateral extension comprises a pin which engages a notched recess contained in said concave curved surface of said engaging lever when said setting and drive levers are held together.

4. The apparatus of claim 1, wherein there is further provided electrically actuable means for engaging and stopping said connecting rod in selected positions.

5. The apparatus of claim 4 wherein said electrically actuatable means includes an electromagnetically actuated toggle lever which operatively engages and stops said connecting rod in selected positions in response to electrical command signals.

* * * * *